US005556039A

United States Patent [19]

Minamimura et al.

[11] Patent Number: 5,556,039

[45] Date of Patent: Sep. 17, 1996

[54] CRUSHING MACHINE APPARATUS AND A METHOD FOR CLEANING THE CRUSHING MACHINE APPARATUS

[75] Inventors: Masaaki Minamimura; Haruo Okada; Kikuo Sakurada, all of Nagano, Japan

[73] Assignee: Nissei Plastic Industrial Co., Ltd., Nagano, Japan

[21] Appl. No.: 331,096

[22] Filed: Oct. 28, 1994

[51] Int. Cl.[6] ..... B02C 4/08; B02C 23/24

[52] U.S. Cl. ..... 241/18; 241/47; 241/57; 241/158; 241/166; 241/236

[58] Field of Search ..... 241/18, 47, 57, 241/158, 224, 236, 260.1, DIG. 38, 166

[56] References Cited

U.S. PATENT DOCUMENTS

| | | | |
|---|---|---|---|
| 291,018 | 1/1884 | Ager | 241/57 |
| 2,592,481 | 4/1952 | Spencer et al. | 241/102 |
| 3,682,396 | 8/1972 | Whitney et al. | 241/41 |
| 4,361,290 | 11/1982 | Francis | 241/57 |
| 4,754,933 | 7/1988 | Leuthold et al. | 241/57 |
| 5,110,059 | 5/1992 | Titmas et al. | 241/47 |
| 5,289,978 | 3/1994 | Lundquist | 241/57 |
| 5,386,947 | 2/1995 | Omann | 241/41 |

*Primary Examiner*—John Husar

*Attorney, Agent, or Firm*—Sughrue, Mion, Zinn, Macpeak & Seas

[57] ABSTRACT

A crushing machine is disclosed which comprises a casing, a coarsely crushing blade which crushes scrap into coarsely crushed pieces, and a finely crushing blade which crushes the coarsely crushed pieces into finely crushed pieces. The coarsely crushing blade and the finely crushing blade are rotatably disposed in the casing, and jetting holes are formed in the coarsely crushing blade to jet compressed air radially outward from the coarsely crushing blade. Also, the jetting holes are connected to a compressed air passageway which is formed in the rotary shaft of the coarsely crushing blade. In addition, a stationary jetting hole is formed in the wall of the casing to jet compressed air towards a gap between the coarsely crushing blade and the finely crushing blade.

19 Claims, 4 Drawing Sheets

CRUSHING MACHINE APPARATUS AND A METHOD FOR CLEANING THE CRUSHING MACHINE APPARATUS

BACKGROUND OF THE INVENTION

1. Field of the Invention

This invention relates to crushing machines. More particularly, this invention relates to a crushing machine that crushes scrap, such as plastic scrap, between the wall of a casing and crushing blades which have a predetermined thickness and which are mounted on a rotary shaft. In addition, the present invention relates to a method for cleaning the crushing machine.

2. Description of the Related Art

In an injection molding operation, pieces of scrap accumulate in the sprue and the runner. The pieces of scrap are crushed by a crushing machine, in which at least one crushing blade is turned, and then are recycled and mixed with the raw material little by little.

In an injection molding operation, sometimes it is necessary to switch the raw material with another or to replace the metal mold with another. In this situation, the crushed material is removed from the interior of the crushing machine (i.e., the crushing machine is cleaned).

A conventional crushing machine is cleaned as follows. A compressed air hose is inserted into the crushing machine through a material charging inlet or a material discharging outlet and applies compressed air to remove the crushed material. Alternatively, the casing of the crushing machine may be removed to apply compressed air to the crushing blades and the wall of the casing.

When the injection molding operation is restarted after switching the raw material, the crushed material that accumulated before the crushing machine was cleaned is discharged. Thus, after the crushed material is removed from the crushing machine, the crushed material is not used or recycled.

In addition, during the manual cleaning of a conventional crushing machine, a significant amount of the crushed material may not be removed. Furthermore, the manual cleaning operation is disadvantageous because it takes a relatively long period of time to perform and because the compressed air may scatter dust around the interior of the crushing machine.

Also, since the crushing blades are rotatably provided in the casing, there are gaps between the wall of the casing and the crushing blades. Therefore, when rotating the crushing blades crush plastic scrap into small pieces, the crushed material becomes caught in the gaps. Since, it is impossible to apply the compressed air directly to the gaps, the crushed material is liable to remain in the gaps even if the interior of the crushing machine is cleaned.

Accordingly, when the injection molding operation is restarted, the crushed material must be discharged for a long period of time in order to ensure that all of the old crushed material is removed. Consequently, the production efficiency of a conventional crushing machine is low. In addition, the crushed material which has been discharged cannot be used again, and therefore, there is a problem in handling and discarding the material.

Recently, a crushing machine has been combined with an injection molding machine such that the crushing machine is operated in conjunction with the injection molding machine. However, the cleaning operation can only be performed when the injection molding machine is not operating. Accordingly, it is inefficient to perform the manual cleaning operation for a long period of time. Therefore, an object of the invention is to provide a crushing machine which can be cleaned within a short period of time and in which the amount of crushed material remaining in the crushing machine after it is cleaned is minimized. Another object of the invention is to provide a method for cleaning the crushing machine.

SUMMARY OF THE INVENTION

In order to achieve the above-described objects of the invention, compressed air should be applied directly to the gaps between the casing and the crushing blades to blow the crushed material out of the gaps. By turning the crushing blade while compressed air is being jetted through its outer periphery, the compressed air can be directly applied to the gaps between the casing and the crushing blades in order completely remove the amount of crushed material from the crushing machine.

The foregoing objects of the invention have been achieved by the following means:

The first means is a crushing machine for crushing scrap which comprises a casing and one or more crushing blades rotatably disposed in the casing. Jetting holes are formed in at least one of the crushing blades such that the jetting holes are opened in the outer periphery of the crushing blade to jet compressed air radially outward from the crushing blade. A compressed air passageway, which supplies compressed air, is formed in the rotary shaft of the crushing blade and is connected to the jetting holes.

The second means is a crushing machine comprising a casing, a first coarsely crushing blade which is rotatably disposed in the casing and which crushes the scrap into coarsely crushed materials, a second coarsely crushing blade which is rotatably disposed in the casing and which crushes the scrap into coarsely crushed materials, and a finely crushing blade which is rotatably disposed in the casing and which crushes the coarsely crushed materials into finely crushed materials. In addition, jetting holes are formed in at least the first coarsely crushing blade such that the jetting holes are opened in an outer periphery of the first coarsely crushing blade and such that the jetting holes jet compressed air radially outward from the first coarsely crushing blade. Furthermore, a compressed air passageway, which supplies compressed air, is formed in a rotary shaft of at least the first coarsely crushing blade and is connected the jetting holes. Finally, the crushing machine also comprises a stationary jetting hole which is formed in a wall of the casing and which jets compressed air towards a space near the first coarsely cutting blade, the second coarsely cutting blade, and/or the finely cutting blade.

The third means is a method for cleaning a crushing machine which comprises a casing and at least one crushing blade rotatably disposed in the casing to crush scrap. The method comprises the steps of turning at least one crushing blade while jetting compressed air through jetting holes that are opened in the outer periphery of at least one crushing blade and that are connected to a compressed air passageway formed in a rotary shaft of at least one crushing blade, and removing crushed material, which is crushed by at least one crushing blade, out of the crushing machine through a discharging outlet of a collector which discharges the crushed material.

In the crushing machine of the present invention, compressed air is jetted through the outer periphery of the crushing blade while it is being rotated. Therefore, the compressed air is applied directly to the gap between the casing and the crushing blade. Thus, the amount of crushed material remaining in the crushing machine is significantly reduced.

Furthermore, since the compressed air is jetted while the crushing blade is being rotated, the compressed-air-jetting direction is also turned so that the crushed material remaining in other portions of the casing is blown towards the discharging outlet. This crushed-material-blowing operation is performed in conjunction with the operation of applying compressed air directly to the gaps in order to minimize the amount of crushed material in the crushing machine.

DESCRIPTION OF THE PREFERRED EMBODIMENTS

The present invention will be described in more detail with reference to the accompanying drawings.

Figure 1:
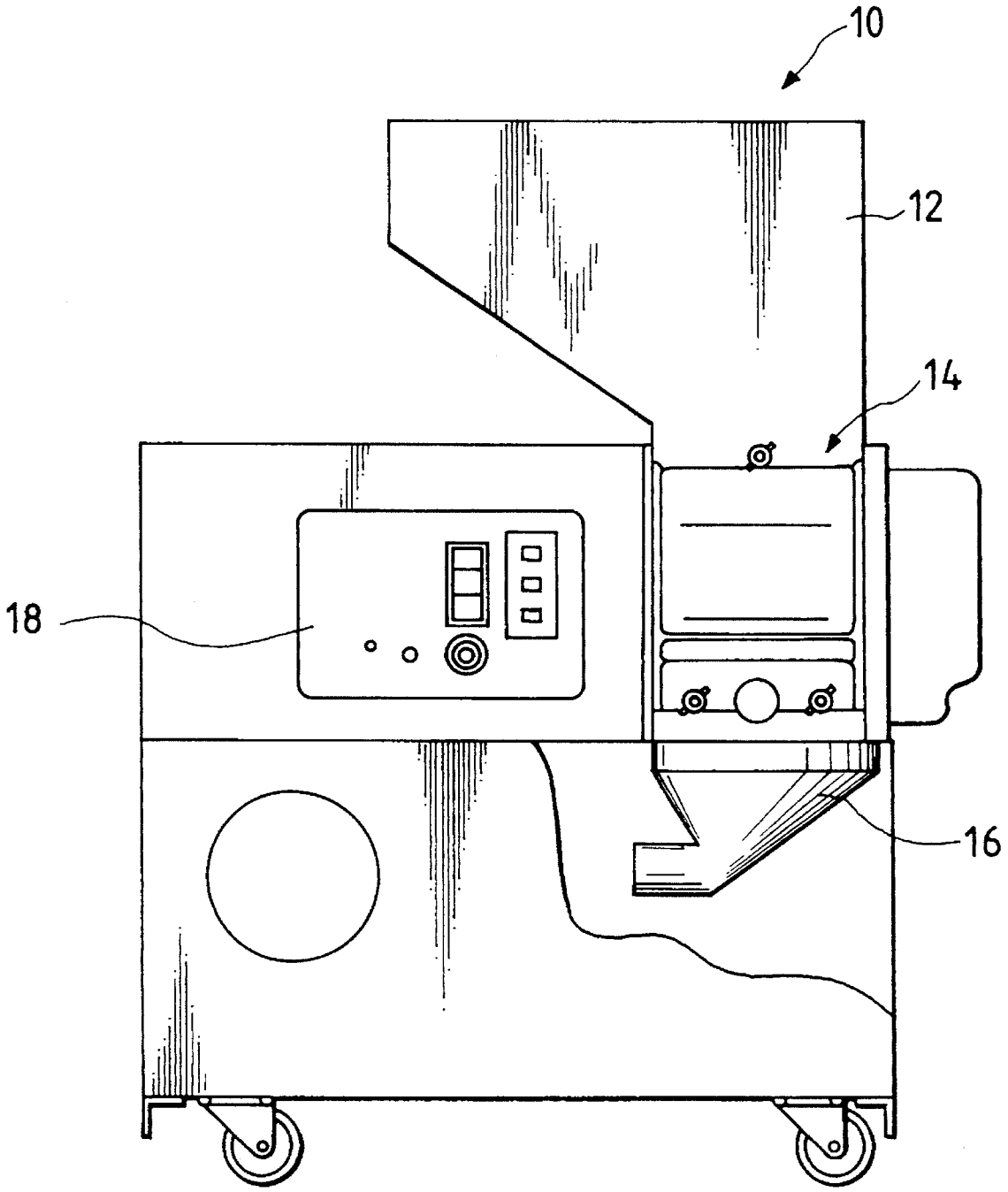
FIG. 1 is a front view of one embodiment of a crushing machine of the present invention.

FIG. 1 is a front view, with parts cut away, of a crushing machine which constitutes one embodiment of the present invention. The crushing machine 10 comprises a hopper 12, which receives scrap materials, a crushing machine body 14 located below the hopper 12, and a collector 16 located below the crushing machine body 14. The crushing machine 10 further comprises a control board 18 for controlling the operation of the crushing machine 10 (e.g. the rotation of the crushing blades).

Figure 2:
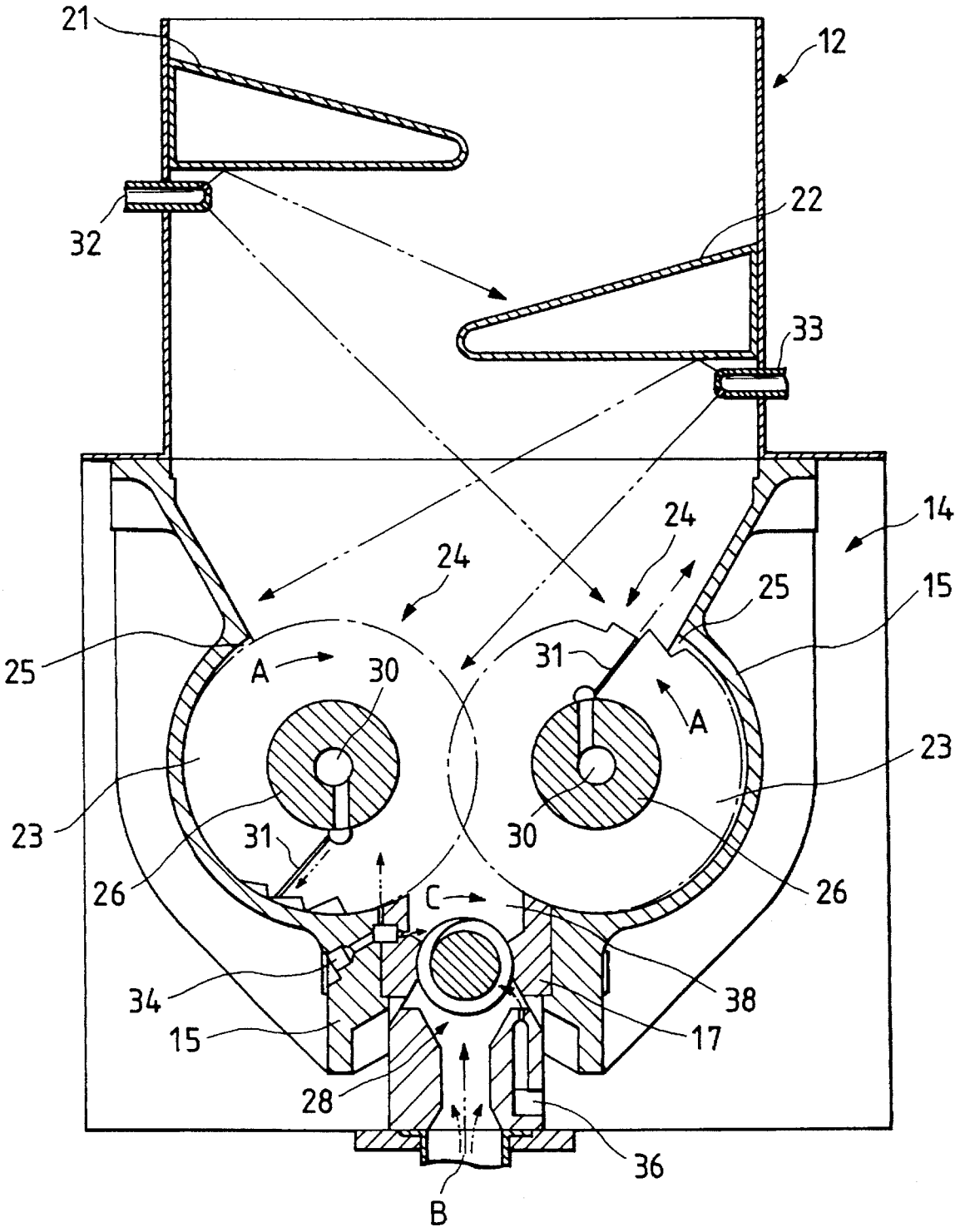
FIG. 2 is a sectional view of the crushing machine shown in FIG. 1.

FIG. 2 is a sectional view of the hopper 12 and the crushing machine body 14 shown in FIG. 1. Baffle plates 21 and 22 are provided in the hopper 12 to prevent crushed materials from scattering out of the crushing machine 10.

The crushing machine body 14 has a casing 15, coarsely crushing blades 24, and a finely crushing blade 28. The coarsely crushing blades 24 are rotated in the directions of the arrows A, and the finely crushing blade 28 is rotated in the direction of the arrow C. A gap 25 is formed between the inner surface of the casing 15 and each of the coarsely crushing blades 24.

In this embodiment, each of the coarsely crushing blades 24 comprise a plurality of edge members 23 and liners (not shown) which are mounted alternately on the rotary shaft 26. The finely crushing blade 28 is provided below the coarsely crushing blades 24.

Scrap is crushed into coarsely crushed materials by the coarsely crushing blades 24 and then ground into finely crushed materials by the finely crushing blade 28. The finely crushing blade 28 is a screw type crushing blade and the coarsely crushed materials are ground between the finely crushing blade 28 and a stationary member 17 which is secured to the casing 15. The collector 16 is provided below the finely crushing blade 28 and discharges the finely crushed materials from the crushing machine.

In the crushing machine body 14, compressed air passageways 30 are formed in the rotary shafts 26 of the coarsely crushing blades 24 along the central axes of the coarsely crushing blades 24. The compressed air passageways 30 are connected to jetting holes 31 which are formed in the coarsely crushing blades 24. Compressed air is jetted through the jetting holes 31 in a direction which is radially outward from the coarsely crushing blades 24 in order to remove crushed materials from the gaps 25.

As described above, in each of the coarsely crushing blades 24, the edge members 23 and the liners are alternately mounted on the rotary shaft. The jetting holes 31 are extended through the edge members 23 and may form openings in the edge members 23 at respectively different locations of the edge members 23 or at the same respective locations.

In a conventional crushing machine, if compressed air is merely blown toward the gaps 25 from an external source, the external source cannot fully jet air into all portions of the gaps 25. Consequently, it is considerably difficult to remove a substantial amount of the crushed material from the gaps 25. However, in this embodiment, compressed air is jetted through the jetting holes 31 while the coarsely crushing blades 24 are being rotated. Therefore, compressed air is jetted directly into the gaps 25, and the crushed material is easily removed.

Also, the coarsely crushing blades 24 and the finely crushing blade 28 define a space 38 in the crushing machine body 14. A stationary compressed air jetting hole 34 is formed in the casing 15 near the finely crushing blade 28 and has a jetting outlet through which compressed air is jetted directly into the space 38. Furthermore, the stationary compressed air jetting hole 34 has another jetting outlet through which compressed air is jetted towards the gaps 25.

As described above, in a conventional crushing machine, crushed materials are liable to accumulate in the gaps 25, and removing the crushed materials from the gaps 25 is rather difficult. However, in the present invention, compressed air is jetted through the jetting holes 31 which are formed in the coarsely crushing blades 24 and through the stationary compressed air jetting hole 34 which is formed in the casing 15. As a result, the compressed air is applied directly to the gaps 25 and the space 38, and the compressed air is able to easily remove the crushed materials therefrom.

Figure 3:
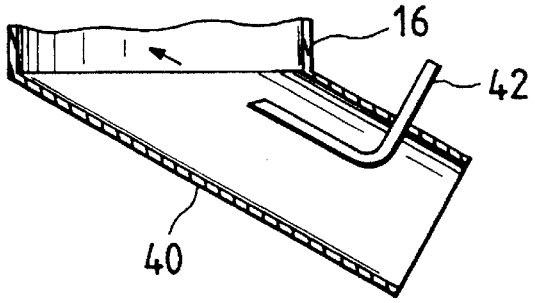
FIG. 3 is a sectional view of a compressed air jetting nozzle provided for a collector of the crushing machine.

In the crushing machine 10, a plurality of compressed air jetting nozzles are provided for the hopper 12 and the casing 15. In the hopper 12, the compressed air jetting nozzles 32 and 33 are provided below the baffle plates 21 and 22, respectively. The compressed air jetting nozzles 32 and 33 have jetting outlets through which compressed air is jetted to the baffle plates 21 and 22 and have jetting outlets through which compressed air is jetted towards the coarsely crushing blades 24. Therefore, the compressed air jetting nozzles 32 and 33 are able to clean the bottom sides of the baffle plates 21 and 22 and the coarsely crushing blades 24. Also, a compressed air jetting nozzle 36 is provided in the casing 15 through which compressed air is jetted directly to the finely crushing blade 28. In addition, as shown in FIG. 3, a compression air jetting nozzle 42 is provided at the discharging outlet 40 of the collector 16 and jets compressed air B (FIG. 2). The compressed air B jetted through the compressed air jetting nozzle 42 is applied to the finely crushing blade 28. The compressed air B applied together with the compressed air from the compressed air jetting nozzle 36 thoroughly clean the finely crushing blade 28 and the collector 16.

Figure 4:
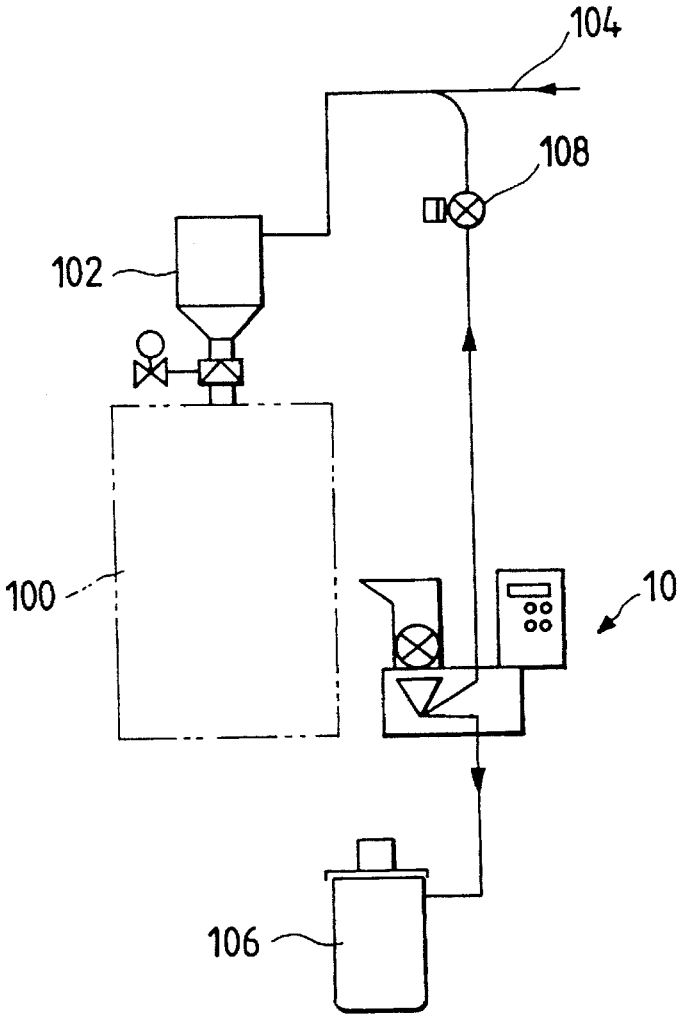
FIG. 4 is a diagram of an injection molding system which includes a crushing machine and an injection molding machine.

The crushing machine 10 shown in FIGS. 1 though 3 can be used in conjunction with an injection molding machine 100 as shown in FIG. 4 to form an injection molding system. In the injection molding system, scrap which accumulates in the sprues and runners of the injection molding machine 100 are crushed by the crushing machine 10 into crushed materials. The crush materials travel through a control valve 108 and mix with the raw material which is supplied through a raw material supplying pipe 104. The mixture of the crushed materials and the raw material is supplied to a hopper 102 and then to the injection molding machine 100.

While the injection molding machine 100 is not operating (e.g. when switching the molding material for a different molding material) the crushing machine 10 is cleaned. Consequently, the crushed material is removed from the crushing machine 10 and is discharged into a tank 106. During this cleaning operation, the control valve 108 remains closed.

Figure 5:
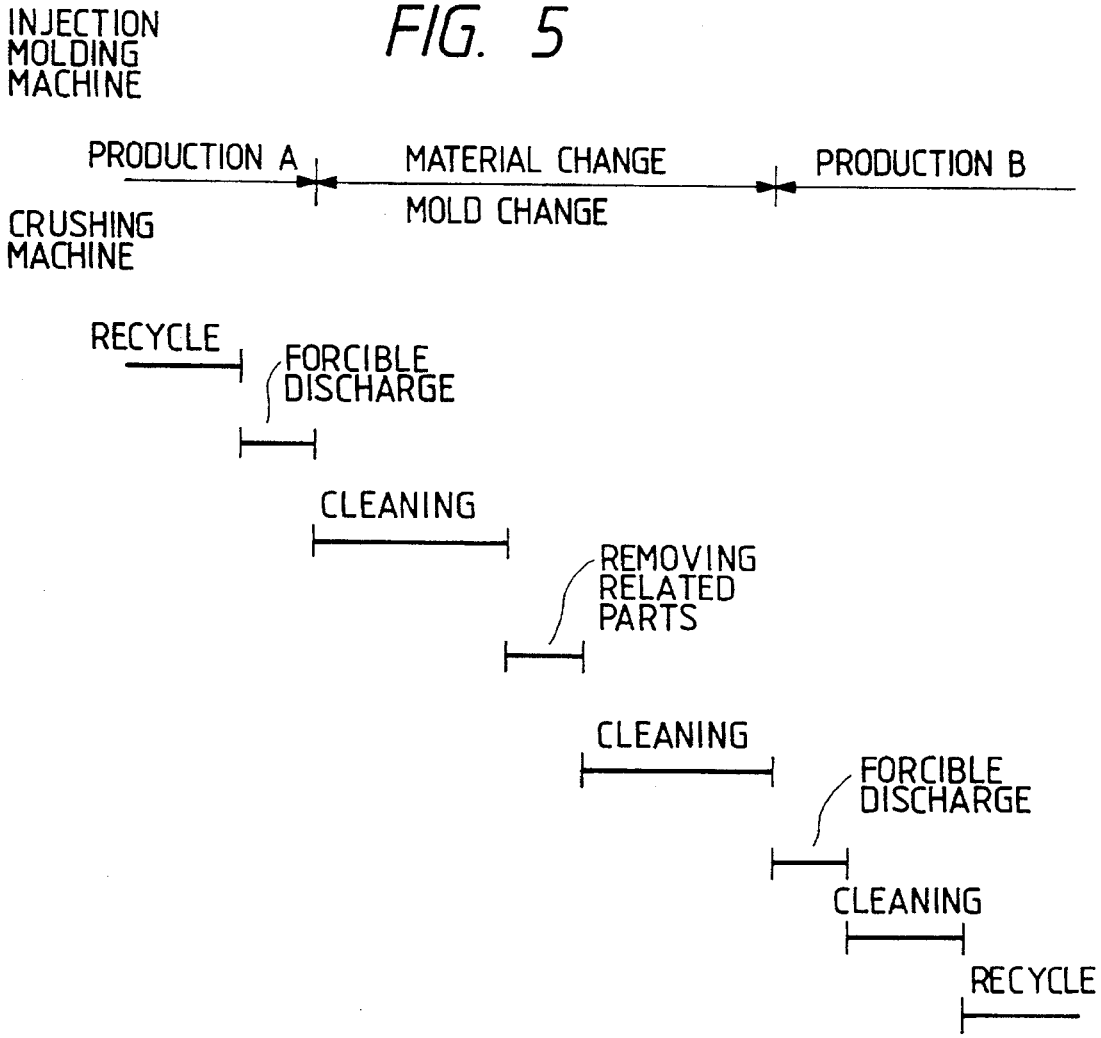
FIG. 5 is a process diagram showing the operations of the injection molding machine and the crushing machine.

FIG. 5 shows the cleaning operation of the crushing machine 10 in the injection molding system shown in FIG. 4. As shown in FIG. 5, after the injection molding machine 100 produces and molds a material A, a material B is produced. However, before producing material B, the operation of the injection molding machine 100 is turned off for a certain period of time in order to switch the material A with the material B and for replacing the metal mold for the material A with another metal mold for the material B. During this period, the crushing machine 10 is cleaned.

Thus, immediately before the production of material A ends, the injection molding machine 100 forcibly discharges molten resin or the like from the injection cylinder. Then, the crushing machine 10 suspends the recycling of the crushed materials and forcibly discharges the crushed materials into the tank 106. Next, after the operation of the injection molding machine 100 stops, a series of cleaning steps are performed by the crushing machine 10. Thereafter, the equipment of the crushing machine 10 (e.g. the supply hose for supplying scrap to the crushing machine 10) is cleaned.

Furthermore, for a certain period of time after the start of the production of material B, all the crushed material is forcibly discharged into the tank 106 instead of being supplied to the injection molding machine 100. This step replaces any crushed material left in the crushing machine 10 during the production of material A with the crushed material to be used during the production of material B. Thereafter, the series of cleaning steps are carried out again, and the recycling of the crush material is restarted.

Figure 6:
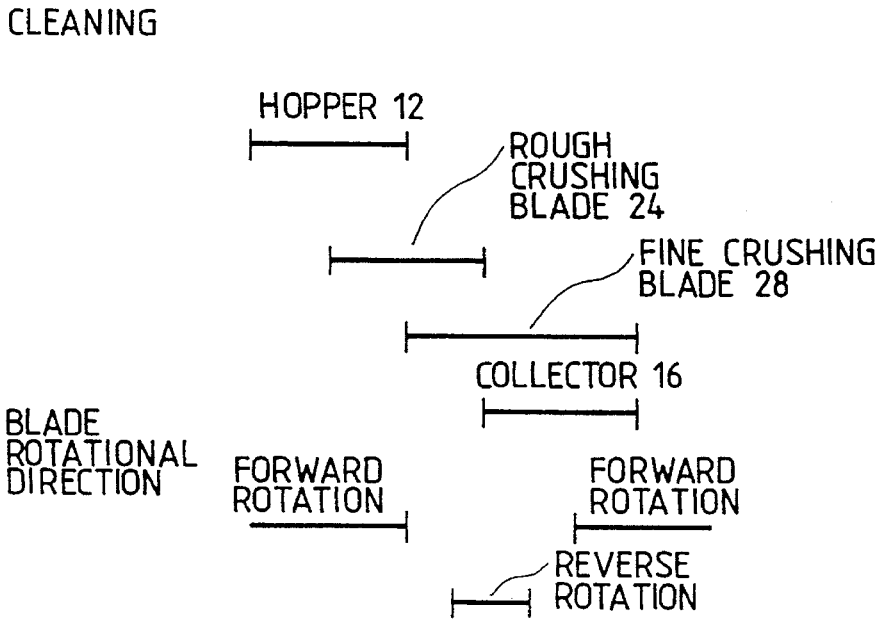
FIG. 6 is also a process diagram for describing a cleaning operation for the crushing machine.

FIG. 6 shows the above-mentioned series of cleaning steps. First, compressed air is jetted through the compressed air jetting nozzles 32 and 33 in the hopper 12 to clean the interior of the hopper 12. Then, compressed air is jetted through the jetting holes 31 of the coarsely crushing blades 24 to clean the gaps 25. Next, compressed air is jetted through the stationary compressed air jetting hole 34 to clean the gaps 25 and the space 38. Compressed air is then jetted through the compressed air jetting nozzle 36 to clean the finely crushing blade 28. Finally, compressed air is jetted through the compressed air jetting nozzles 36 and 42 to clean the finely crushing blade 28 and the collector 16.

Therefore, in the present embodiment, the upper parts of the crushing machine 10 are cleaned before the lower parts. Also, the compressed air for cleaning the upper parts is jetted for different periods of time than the compressed air for cleaning the lower parts. As a result, the crushed material is prevented from sticking onto the upper parts of the crushing machine.

In addition, the cleaning process can be improved by providing a step in which the coarsely crushing blades 24 and the finely crushing blade 28 are also turned in the opposite direction while compressed air is jetted through the jetting holes 31 and the compressed air jetting nozzle 36, respectively. In the present embodiment, the series of cleaning steps are performed in about one (1) minute.

The crushing machine 10 of the invention can be operated in conjunction with the injection molding machine 100 and can be cleaned while the injection molding machine 100 is not operating. In addition, in the crushing machine 10, compressed air can be applied directly to the parts which are rather difficult to reach during a conventional cleaning. Thus, the crushing machine can be sufficiently cleaned.

The above-described embodiment may also be modified so that the casing 15 shown in FIG. 2 can be freely opened and closed. Therefore, when the injection molding machine 100 is turned off for a long time, the casing 15 may be manually opened to clean the crushing blades.

Also, in the above-described crushing machine 10, only the coarsely crushing blades 24 have the compressed-air-jetting function. However, the finely crushing blade 28 may be modified so that it has a compressed air passageway and jetting holes to perform a similar compressed-air-jetting function.

Furthermore, the technical concept of the invention is obviously applicable to a crushing machine with a single shaft that has only one crushing blade. In such a case, a compressed air passageway and jetting holes are respectively formed in the shaft and crushing blade to perform the compressed-air-jetting function.

The crushing machine 10 can be cleaned quickly and can be operated in conjunction with the injection molding machine 100. Therefore, the molding materials can be automatically switched in the injection molding machine 100, and the scrap also can be automatically recycled.

In addition, the previous description of the preferred embodiments is provided to enable any person skilled in the art to make or use the present invention. The various modifications to these embodiments will be readily apparent to those skilled in the art, and the generic principles defined herein may be applied to other embodiments without the use of inventive faculty. Therefore, the present invention is not intended to be limited to the embodiments described herein but is to be accorded the widest scope consistent with the principles and novel features disclosed herein.

What is claimed is:

1. A crushing machine for crushing scrap, such as plastic scrap, which comprises:

a casing; and one or more crushing blades rotatably disposed in said casing, wherein jetting holes are formed in at least one of said one or more crushing blades such that said jetting holes are opened in an outer periphery of said at least one of said one or more crushing blades to jet compressed air radially outward from said at least one of said one or more crushing blades and wherein a compressed air passageway, which supplies compressed air, is formed in a rotary shaft of said at least one of said one or more crushing blades and is connected to said jetting holes.

2. The crushing machine according to claim 1, wherein said one or more crushing blade comprises:

a coarsely crushing blade for crushing said scrap into coarsely crushed materials; and a finely crushing blade for crushing said coarsely crushed materials into finely crushed materials.

3. The crushing machine according to claim 2, wherein said jetting holes and said compressed air passageway are formed in at least said coarsely crushing blade.

4. The crushing machine according to claim 3, wherein said crushing machine further comprises:

a stationary jetting hole for jetting compressed air towards a space wherein said stationary jetting hole is formed in the wall of said casing and wherein said space is located near said coarsely crushing blade and/or said finely crushing blade.

5. The crushing machine according to claim 2, wherein said jetting holes and said compressed air passageway are formed in at least said finely crushing blade.

6. A crushing machine for crushing scrap, such as plastic scrap, comprising:

a casing;

a first coarsely crushing blade which is rotatably disposed in said casing and which crushes said scrap into coarsely crushed materials;

a second coarsely crushing blade which is rotatably disposed in said casing and which crushes said scrap into coarsely crushed materials;

a finely crushing blade which is rotatably disposed in said casing and which crushes said coarsely crushed materials into finely crushed materials;

first jetting holes which are formed in said first coarsely crushing blade such that said first jetting holes are opened in an outer periphery of said first coarsely crushing blade and which jet compressed air radially outward from said first coarsely crushing blade; and a first compressed air passageway which is formed in a rotary shaft of said first coarsely crushing blade and which is connected to said first jetting holes.

7. The crushing machine for crushing scrap according to claim 6, further comprising:

second jetting holes which are formed in said second coarsely crushing blade such that said second jetting holes are opened in an outer periphery of said second coarsely crushing blade and which jet compressed air radially outward from said second coarsely crushing blade; and a second compressed air passageway which is formed in a rotary shaft of said second coarsely crushing blade and which is connected to said second jetting holes.

8. The crushing machine for crushing scrap according to claim 7, further comprising:

a hopper which feeds said scrap into said casing;

at least one baffle plate disposed on one side of said hopper; and at least one baffle plate jet nozzle which is disposed below said at least one baffle plate and which jets compressed air toward said at least one baffle plate.

9. The crushing machine for crushing scrap according to claim 8, further comprising:

a first stationary jetting hole for jetting compressed air towards a space wherein said first stationary jetting hole is formed in a wall of said casing and wherein said space is located near said first coarsely cutting blade, said second coarsely cutting blade, and/or said finely cutting blade.

10. The crushing machine for crushing scrap according to claim 9, further comprising:

a second stationary jetting hole which is disposed below said finely crushing blade and which jets compressed air toward said finely crushing blade.

11. The crushing machine for crushing scrap according to claim 6, further comprising:

finely jetting holes which are formed in said finely crushing blade such that said finely jetting holes are opened in an outer periphery of said finely crushing blade and which jet compressed air radially outward from said finely crushing blade; and a finely compressed air passageway which is formed in a rotary shaft of said finely crushing blade and which is connected to said finely jetting holes.

12. A method of cleaning a crushing machine, which includes a casing and at least one crushing blade rotatably disposed in said casing to crush scrap into crushed material, comprising the steps of:

turning said at least one crushing blade in a first direction while jetting compressed air through first jetting holes, wherein said first jetting holes are connected to a first compressed air passageway formed in a rotary shaft of said at least one crushing blade and wherein said first jetting holes are opened in the outer periphery of said at least one crushing blade to jet said compressed air radially outward from said at least one crushing blade; and removing said crushed material, which is crushed by said at least one crushing blade, out of said crushing machine through a discharging outlet of a collector which discharges said crushed material.

13. A method of cleaning a crushing machine according to claim 12, further comprising the step of:

jetting compressed air through at least one baffle plate jet nozzle which is disposed below at least one baffle plate and which jets compressed air toward said at least one baffle plate.

14. A method of cleaning a crushing machine according to claim 12, further comprising the step of:

jetting compressed air through a stationary compressed air jetting hole wherein said compressed air is jetted toward a finely crushing blade to clean said finely crushing blade.

15. A method of cleaning a crushing machine according to claim 12, further comprising the step of:

jetting compressed air through a stationary compressed air jetting hole wherein compressed air is jetted toward said collector to clean said collector.

16. A method of cleaning a crushing machine according to claim 12, further comprising the step of:

turning a finely crushing blade in a second direction while jetting compressed air through finely jetting holes, wherein said finely jetting holes are connected to a finely compressed air passageway formed in a rotary shaft of said finely crushing blade and wherein said finely jetting holes are opened in the outer periphery of said finely crushing blade.

17. A method of cleaning a crushing machine according to claim 12, further comprising the steps of:

jetting compressed air through at least one baffle plate jet nozzle which is disposed below at least one baffle plate and which jets compressed air toward said at least one baffle plate;

jetting compressed air through a first stationary compressed air jetting hole wherein compressed air is jetted toward a finely crushing blade to clean said finely crushing blade; and jetting compressed air through a second stationary compressed air jetting hole wherein said compressed air is jetted toward said collector to clean said collector.

18. A method of cleaning a crushing machine according to claim 17, further comprising the steps of:

turning one of said at least one crushing blade in a second direction while jetting compressed air through said first jetting holes, wherein said second direction is opposite to said first direction and wherein said one of said at least one crushing blade is turned in said second direction after said one of said at least one crushing blade has been turned in said first direction.

19. A method of cleaning a crushing machine according to claim 18, further comprising the step of:

turning a finely crushing blade in a third direction while jetting compressed air through finely jetting holes, wherein said finely jetting holes are connected to a finely compressed air passageway formed in a rotary shaft of said finely crushing blade and wherein said finely jetting holes are opened in the outer periphery of said finely crushing blade.

* * * * *